US008962133B2

(12) United States Patent
Sato et al.

(10) Patent No.: US 8,962,133 B2
(45) Date of Patent: Feb. 24, 2015

(54) ELECTROPHOTOGRAPHIC MEMBER, INTERMEDIATE TRANSFER MEMBER, IMAGE FORMING APPARATUS, AND METHOD FOR MANUFACTURING ELECTROPHOTOGRAPHIC MEMBER

(71) Applicant: Canon Kabushiki Kaisha, Tokyo (JP)

(72) Inventors: Koichi Sato, Kawasaki (JP); Naoto Kameyama, Kawasaki (JP); Kenji Onuma, Machida (JP); Koichi Nakamura, Funabashi (JP); Tadanobu Yoshikawa, Toride (JP); Hiroshi Tominaga, Kashiwa (JP); Akira Watanabe, Yokohama (JP); Yasushi Shimizu, Yokohama (JP); Rieko Sakamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 13/706,334

(22) Filed: Dec. 5, 2012

(65) Prior Publication Data

US 2013/0149540 A1 Jun. 13, 2013

(30) Foreign Application Priority Data

| | | |
|---|---|---|
| Dec. 12, 2011 | (JP) | 2011-271354 |
| Dec. 12, 2011 | (JP) | 2011-271678 |
| Sep. 28, 2012 | (JP) | 2012-215699 |

(51) Int. Cl.
*B05D 3/02* (2006.01)
*B05D 3/06* (2006.01)

(Continued)

(52) U.S. Cl.
CPC ..... *G03G 5/14* (2013.01); *G03G 5/14726* (2013.01); *B05D 3/068* (2013.01); *B05D 3/12* (2013.01);

(Continued)

(58) Field of Classification Search
None
See application file for complete search history.

(56) References Cited

U.S. PATENT DOCUMENTS

| | | | |
|---|---|---|---|
| 5,112,656 | A | 5/1992 | Nakamura et al. |
| 5,229,237 | A | 7/1993 | Kawamorita et al. |

(Continued)

FOREIGN PATENT DOCUMENTS

| | | | |
|---|---|---|---|
| CN | 1397030 | A | 2/2003 |
| JP | 8-187773 | A | 7/1996 |
| JP | 2001-13801 | A | 1/2001 |
| JP | 2007-316622 | A | 12/2007 |
| JP | 2009-192901 | A | 8/2009 |

OTHER PUBLICATIONS

European Search Report dated Mar. 8, 2013 in European Application No. 12196221.1.
Chinese Office Action dated May 19, 2014 in Chinese Application No. 201210536338.X.

*Primary Examiner* — Ramsey Zacharia
(74) *Attorney, Agent, or Firm* — Fitzpatrick, Cella, Harper and Scinto

(57) ABSTRACT

An object of the present invention is to provide: an electrophotographic member which enhances image quality, prevents the lowering of a grade of an image even when images have been repeatedly output, and can remarkably enhance the stability of the grade of the image; an intermediate transfer member; and an image forming apparatus. The electrophotographic member includes a base layer and a surface layer, wherein the surface layer has a binder resin, perfluoropolymer fine particles, a fluorocarbon resin dispersing agent and a particular fluorine compound, wherein the perfluoropolymer fine particle has a fluorine compound carried on its surface.

11 Claims, 3 Drawing Sheets

(51) Int. Cl.

| | |
|---|---|
| ***B05D 3/10*** | (2006.01) |
| ***B05D 3/12*** | (2006.01) |
| ***G03G 15/16*** | (2006.01) |
| ***G03G 5/14*** | (2006.01) |
| ***G03G 5/147*** | (2006.01) |

(52) U.S. Cl.

CPC *B05D 3/107* (2013.01); *B05D 3/02* (2013.01); *G03G 2215/1695* (2013.01); *G03G 15/162* (2013.01); *G03G 2215/0129* (2013.01)

USPC ..... 428/327; 428/421; 428/422; 428/522; 399/308; 427/341; 427/355; 427/385.5; 427/535

(56) References Cited

U.S. PATENT DOCUMENTS

| | | | |
|---|---|---|---|
| 5,357,320 | A | 10/1994 | Kashimura et al. |
| 5,393,628 | A | 2/1995 | Ikezue et al. |
| 5,455,135 | A | 10/1995 | Maruyama et al. |
| 5,468,584 | A | 11/1995 | Go et al. |
| 5,485,250 | A | 1/1996 | Kashimura et al. |
| 5,486,440 | A | 1/1996 | Kashizaki et al. |
| 5,488,461 | A | 1/1996 | Go et al. |
| 5,667,926 | A | 9/1997 | Maruyama et al. |
| 5,693,443 | A | 12/1997 | Nakamura et al. |
| 5,695,898 | A | 12/1997 | Go et al. |
| 5,729,801 | A | 3/1998 | Maruyama et al. |
| 5,837,412 | A | 11/1998 | Suzuki et al. |
| 5,923,925 | A | 7/1999 | Nakamura et al. |
| 5,932,383 | A | 8/1999 | Nakata et al. |
| 5,944,930 | A | 8/1999 | Takeuchi et al. |
| 6,016,414 | A | 1/2000 | Anayama et al. |
| 6,232,025 | B1 | 5/2001 | Srinivasan |
| 6,664,014 | B1 | 12/2003 | Kikuchi et al. |
| 6,942,952 | B2 | 9/2005 | Uesugi et al. |
| 7,700,255 | B2 | 4/2010 | Kurachi et al. |
| 7,732,113 | B2 | 6/2010 | Nakamura et al. |
| 2008/0304879 | A1 | 12/2008 | Tamura |
| 2009/0226208 | A1* | 9/2009 | Nukada et al. ..... 399/111 |
| 2010/0247919 | A1 | 9/2010 | Wu |
| 2011/0250439 | A1 | 10/2011 | Qi et al. |
| 2013/0017002 | A1 | 1/2013 | Yoshikawa |

* cited by examiner

ELECTROPHOTOGRAPHIC MEMBER, INTERMEDIATE TRANSFER MEMBER, IMAGE FORMING APPARATUS, AND METHOD FOR MANUFACTURING ELECTROPHOTOGRAPHIC MEMBER

BACKGROUND OF THE INVENTION

1. Field of the Invention

The present invention relates to an electrophotographic member which can be used for an electrophotographic type of an image forming apparatus such as a copying machine and a printer, an intermediate transfer member, an image forming apparatus using the electrophotographic member, and a method for manufacturing the electrophotographic member.

2. Description of the Related Art

In recent years, in an electrophotographic type of an image forming apparatus such as a copying machine and a printer, an image forming apparatus has been marketed which can obtain a color image of high quality. Generally, when obtaining the color image of the high quality, firstly, the image forming apparatus develops a toner image of each color by each color, then sequentially transfers the developed image onto an intermediate transfer member, and forms the color image on the intermediate transfer member. Next, the image forming apparatus collectively retransfers the color image which has been formed on this intermediate transfer member onto a transfer material, and obtains the color image of the high quality having little misalignment in the image. The intermediate transfer member used here is generally a semi-electroconductive belt, and a representative intermediate transfer member includes a belt that is formed from polyimide or polyamide-imide, which are thermosetting resins, in which carbon black is dispersed. Such an intermediate transfer belt can be obtained by: preparing the dispersion liquid that has the carbon black dispersed in a resin varnish or a varnish of polyamic acid which is a precursor of a resin; forming a coating film from the dispersion liquid; and baking the coating film. On the other hand, in recent years, it has been investigated to manufacture a belt by melting, extruding and molding a resin composition which has the carbon black dispersed in a thermoplastic resin. This is because the thermoplastic resin can be melted, extruded and molded, and has more advantages than those of the thermosetting resin in points of an environmental load and a cost.

Under these circumstances, an image forming apparatus which is required to operate at a high speed and have high durability is required to further enhance the transfer characteristics of the semi-electroconductive belt. A method of enhancing the transfer characteristics by processing the surface of the semi-electroconductive belt has been proposed as one solution for the requirements. In Japanese Patent Application Laid-Open No. 2009-192901 and Japanese Patent Application Laid-Open No. 2007-316622, an effort has been made to enhance transfer efficiency by coating a fluorine compound having water repellency and oil repellency on the surface layer of the semi-electroconductive belt, in order to reduce an adhesive force of the surface layer of the semi-electroconductive belt.

SUMMARY OF THE INVENTION

As has been described above, a method of coating a fluorine compound on the surface layer of an intermediate transfer member is proposed for the purpose of enhancing transfer efficiency, but it has been found that even such an intermediate transfer member occasionally causes the degradation of image quality of a transferred image in a process of transferring the image onto a transfer material from the intermediate transfer member, which originates in the deterioration of the surface layer of the intermediate transfer member, when the intermediate transfer member has repeatedly output images. As a result of having investigated a mechanism by which such a phenomenon occurs, it has been considered as the reason that the surface of the intermediate transfer member chemically deteriorates by an electric discharge in the transfer process, and physically deteriorates by an abrasion or the like of the surface layer in a cleaning process.

The development of an intermediate transfer member having such high durability is desired as to be capable of keeping a high transfer efficiency of the surface layer of the intermediate transfer member even when the image forming apparatus has thus repeatedly printed images. Particularly, it is desired for an image forming apparatus which prints images at a high speed to have properties of excellently keeping a transfer performance when thus printing a large number of images.

An object of the present invention is to provide an electrophotographic member which enhances the durability, and can keep the transfer characteristics even when having repeatedly output images.

In addition, an object of the present invention is to provide an intermediate transfer member which enhances the durability, and can keep the transfer characteristics even when having repeatedly output images.

In addition, an object of the present invention is to provide an image forming apparatus which resists lowering a grade of an image even when having repeatedly output images, and can print adequate images over a long period of time.

In addition, an object of the present invention is to provide a process of preparing an electrophotographic member which can keep the transfer characteristics even when having repeatedly output images.

The present invention provides an electrophotographic member which includes a base layer and a surface layer, wherein the surface layer has a binder resin, perfluoropolymer fine particles, a fluorocarbon resin dispersing agent and a fluorine compound, wherein the perfluoropolymer fine particle has a fluorine compound carried on its surface, and wherein a fluorine compound is a perfluoropolyether compound or a branched polymer compound having a perfluoroalkyl group.

Furthermore, the present invention provides an intermediate transfer member to be used in an image forming apparatus which primarily transfers a toner image that has been formed on a first image bearing member onto the intermediate transfer member, and then secondarily transfers the toner image that has been primarily transferred onto the intermediate transfer member onto a second image bearing member to obtain an image, wherein the intermediate transfer member is the electrophotographic member.

Furthermore, the present invention provides an image forming apparatus which primarily transfers a toner image that has been formed on a first image bearing member onto an intermediate transfer member, and then secondarily transfers the toner image that has been primarily transferred onto the intermediate transfer member onto a second image bearing member to obtain an image, wherein the intermediate transfer member is the electrophotographic member.

Furthermore, the present invention provides a process of preparing the electrophotographic member which includes forming a surface layer on the base layer by; a step of coating a mixture solution comprising the perfluoropolymer fine particles, the fluorocarbon resin dispersing agent and the fluorine compound on the base layer; and a step of polymerizing the polymerizable monomer.

By employing the electrophotographic member of the present invention, the image forming apparatus enhances the durability and can keep the transfer characteristics even when having repeatedly output images.

In addition, by employing the intermediate transfer member of the present invention, the image forming apparatus enhances the durability and can keep the transfer characteristics even when having repeatedly output images.

In addition, the image forming apparatus having the above described electrophotographic member as an intermediate transfer member resists lowering the grade of an image even when having repeatedly output images, and can print adequate images over a long period of time.

In addition, the above described process of preparing the electrophotographic member can manufacture an electrophotographic member which has enhanced durability, and can keep the transfer characteristics even when having repeatedly output images.

Further features of the present invention will become apparent from the following description of Examples with reference to the attached drawings.

BRIEF DESCRIPTION OF THE DRAWINGS

FIG. 5A illustrates an image in which the hollow has not occurred; and FIG. 5B illustrates an image in which the hollow has occurred.

DESCRIPTION OF THE EMBODIMENTS

Preferred embodiments of the present invention will now be described in detail in accordance with the accompanying drawings.

An electrophotographic member according to the present invention will be described below in more detail.

Firstly, an image forming apparatus which uses the electrophotographic member of the present invention as an intermediate transfer member will be described below with reference to FIG. 1.

Figure 1:
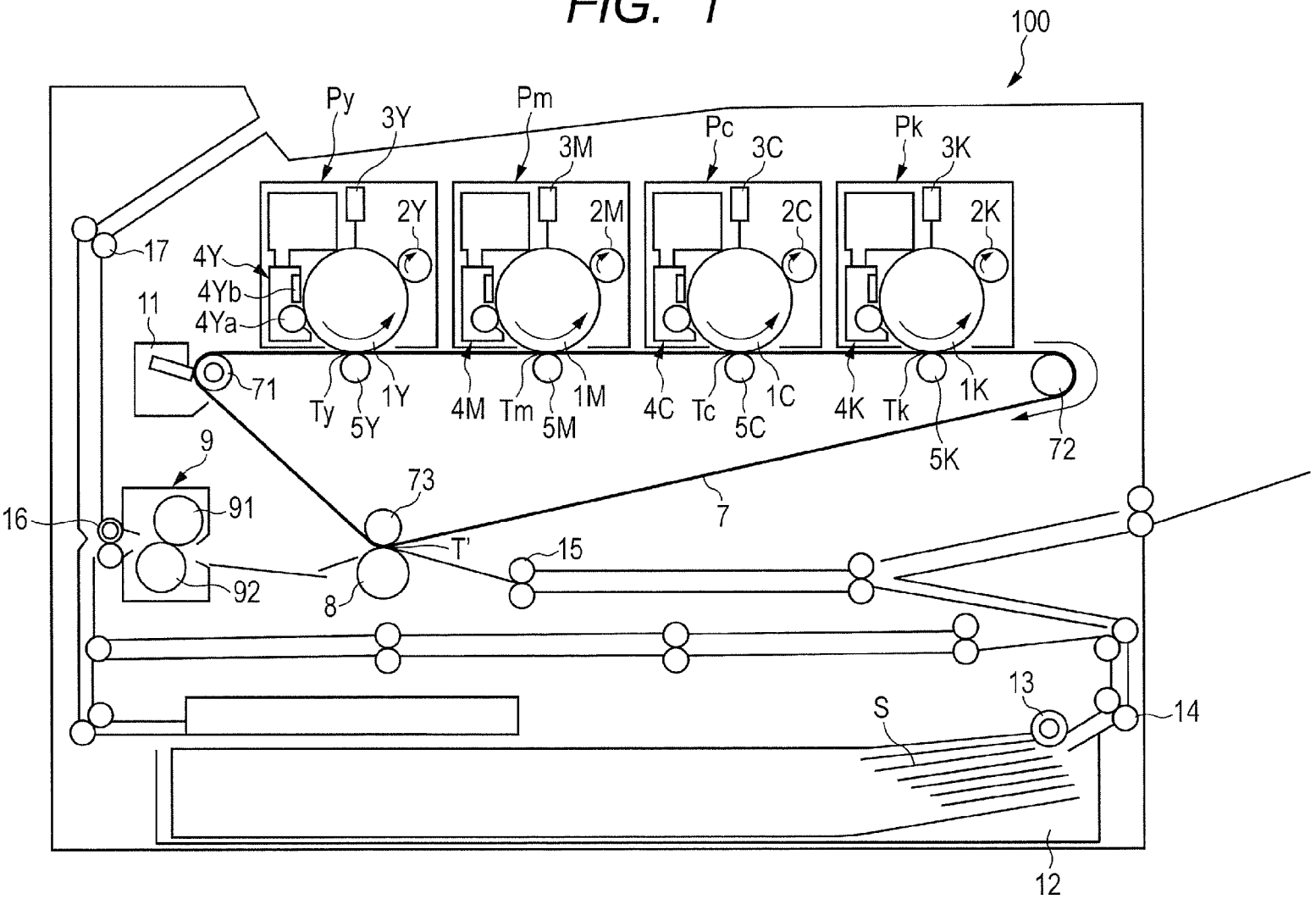
FIG. 1 is an explanatory drawing of a configuration of an image forming apparatus using the present invention.

An image forming apparatus 100 of FIG. 1 is an electrophotographic type of a color image forming apparatus (color laser printer).

The image forming apparatus 100 illustrated in FIG. 1 has image forming units Py, Pm, Pc and Pk which are respective image forming portions of each color component of yellow (Y), magenta (M), cyan (C) and black (K) sequentially arranged in the moving direction along a flat surface portion of an intermediate transfer belt 7 which is an intermediate transfer member. Here, electrophotographic photosensitive members 1Y, 1M, 1C and 1K, charging rollers 2Y, 2M, 2C and 2K, laser exposure devices 3Y, 3M, 3C and 3K, developing apparatuses 4Y, 4M, 4C and 4K, and primary transfer rollers 5Y, 5M, 5C and 5K are illustrated, respectively. Each image forming unit has the same fundamental configuration, and accordingly the detail of the image forming unit will be described only on the yellow image forming unit Py.

The yellow image forming unit Py has a drum type of electrophotographic photosensitive member (hereinafter also referred to as photosensitive drum or first image bearing member) 1Y, as an image bearing member. The photosensitive drum 1Y is formed by using an aluminum cylinder as a substrate, and sequentially stacking a charge-generating layer, a charge-transporting layer and a surface protection layer on the substrate.

In addition, the yellow image forming unit Py has the charging roller 2Y as a charging unit. The surface of the photosensitive drum 1Y is uniformly charged due to a charging bias which has been applied to the charging roller 2Y.

The laser exposure device 3Y of an image exposure unit is arranged in the upper part of the photosensitive drum 1Y. The laser exposure device 3Y scans the surface of the photosensitive drum 1Y which has been uniformly charged, exposes the surface to light according to image information, and forms an electrostatic latent image of a yellow color component on the surface of the photosensitive drum 1Y.

The electrostatic latent image which has been formed on the photosensitive drum 1Y is developed with a toner which is a developer, by the developing apparatus 4Y of a developing unit. Specifically, the developing apparatus 4Y has a developing roller 4Ya which is a developer bearing member, and a controlling blade 4Yb which is a developer-amount controlling member, and accommodates a yellow toner therein which is a developer. The developing roller 4Ya to which the yellow toner has been supplied is brought into light-pressure contact with the photosensitive drum 1Y in a developing portion, and is rotated in a forward direction of and at a different velocity from the photosensitive drum 1Y. The yellow toner which has been transported to the developing portion by the developing roller 4Ya deposits on an electrostatic latent image which has been formed on the photosensitive drum 1Y, due to a developing bias which has been applied to the developing roller 4Ya. Thereby, a visible image (yellow toner image) is formed on the photosensitive drum 1Y.

The intermediate transfer belt 7 is suspended by a driving roller 71, a tension roller 72 and a driven roller 73, comes in contact with the photosensitive drum 1Y, and is moved (rotationally driven) in an arrow direction in the figure. Then, the yellow toner image which has reached a primary transfer portion Ty is primarily transferred onto the intermediate transfer belt 7, by a primary transfer roller 5Y which is a primary transfer member that faces to and is brought into pressure-contact with the photosensitive drum 1Y through the intermediate transfer belt 7.

Similarly, the above described image forming operation is performed in respective units Pm, Pc and Pk of magenta (M), cyan (C) and black (K) along with the movement of the intermediate transfer belt 7, and toner images of four colors of yellow, magenta, cyan and black are stacked on the intermediate transfer belt 7. The toner layers of the four colors are transported according to the movement of the intermediate transfer belt 7, and are collectively transferred onto a transfer material S (hereinafter also referred to as second image bearing member) which is transported at a predetermined timing by a secondary transfer roller 8 of a secondary transfer unit, in a secondary transfer portion T'. In such a secondary transfer, a transfer voltage of several kv is usually applied in order to secure a sufficient transfer ratio, but at this time, an electric discharge occasionally occurs in the vicinity of a transfer nip. Incidentally, this electric discharge becomes one reason of a chemical deterioration of the transfer member.

The transfer material S is stored in a cassette 12 which is a storage portion of the transfer material, is separately supplied to the inner part of the apparatus by a pickup roller 13, and is transported to the secondary transfer portion T' while being synchronized with the toner image of the four colors, which has been transferred onto the intermediate transfer belt 7, by a pair of transportation rollers 14 and a pair of resist rollers 15.

The toner image which has been transferred onto the transfer material S is fixed by a fuser 9 and becomes a full-color image, for instance. The fuser 9 has a fuser roller 91 which is provided with a heating unit, and a pressure roller 92, and fixes the image by heating and pressurizing an unfixed toner image on the transfer material S.

After that, the transfer material S is discharged to the outside by a pair of the transportation rollers 16, a pair of discharge rollers 17 and the like.

A cleaning blade 11 which is a cleaning unit of the intermediate transfer belt 7 is arranged downstream of the secondary transfer portion T' in a driving direction of the intermediate transfer belt 7, and removes a toner which has not been transferred onto the transfer material S in the secondary transfer portion T' and has remained on the intermediate transfer belt 7.

As has been described above, electrically transferring processes of the toner images from the photosensitive member to the intermediate transfer belt and from the intermediate transfer belt to the transfer material are repeatedly performed. In addition, the electrically transferring processes are further repeatedly performed by repeatedly recording the toner images on a large number of the transfer materials.

According to the image outputting test carried out by the present inventors, the deterioration of image quality in the transfer process can be improved by using an intermediate transfer belt having the surface layer that is a coating film formed from a fluorine compound which has low adhesive properties, water repellency and oil repellency on thereof, as is described in the above described Japanese Patent Application Laid-Open No. 2009-192901.

However, according to an image outputting test further carried out by the present inventors, the image quality was improved which was output by an image forming apparatus using the intermediate transfer member coated with the above described fluorine compound having the water repellency and the oil repellency, in an early stage of printing; but an image forming apparatus even using such an intermediate transfer member as is described in Japanese Patent Application Laid-Open No. 2009-192901 gradually degraded the transfer characteristics due to the transferring processes which were repeated when the images were continuously output, and occasionally degraded the image quality to a level equal to the case in which the intermediate transfer member was not coated with the above described fluorine compound having the water repellency and the oil repellency. One cause of this phenomenon is considered to be a chemical deterioration of the surface of the intermediate transfer member, which has been caused by the deterioration of the fluorine compound that is coated on the surface of the intermediate transfer member and has the water repellency and the oil repellency, originating in the electric discharge due to an applied high voltage during transfer in a transferring process, and another cause is considered to be a physical deterioration of the surface of the intermediate transfer member caused by the abrasion and the like of the surface layer during the cleaning process. Among them, the present inventors think that a large cause of the phenomenon originates in the influence of the dissipation of the fluorine compound that has contributed to the lubricity of the surface of the intermediate transfer member, which has been caused by the above described chemical deterioration and/or physical deterioration. The reason which has led to such an idea is as follows.

Firstly, it was suspected that the characteristics of the surface of the intermediate transfer member changed by the deposition of a component in the toner such as a wax which existed on the surface of the crushed type of toner, onto the intermediate transfer member, because the phenomenon as in the above description was seen in a crushed type of toner in many cases; then, the component in the toner which had deposited onto the surface of the intermediate transfer member was carefully wiped off by using a solvent, after the images had been repeatedly output; but the image deterioration was not recovered.

Secondly, as a result of having measured the surface of the intermediate transfer member with X-ray photoelectron spectroscopy (ESCA) which can analyze the chemical composition in the vicinity of the surface of a substance, fluorine atoms in an amount of 10 atom % or more and 30 atom % or less existed on the surface layer of the intermediate transfer member of which the surface of the intermediate transfer member had been coated with the fluorine compound having lubricity, in an early period of printing, but after one thousand or more sheets of the images had been output, the amount of this fluorine atom decreased to several atom % or less.

Thirdly, also the contact angle of hexadecane on the surface of the intermediate transfer member was 40° or more in an early period of the printing, but when several thousands or more sheets of the images were repeatedly output, the contact angle became 20° or less.

From the above described points, it is appropriate to consider that the reason why transfer properties of the intermediate transfer member degrade when the images are repeatedly output originates in the dissipation of the fluorine compound which has enhanced the transfer properties.

The present invention has been designed in order to solve such a problem. Specifically, an electrophotographic member of the present invention includes a base layer and a surface layer, wherein the surface layer has a binder resin, perfluoropolymer fine particles, a fluorocarbon resin dispersing agent and a fluorine compound, wherein the perfluoropolymer fine particles have the fluorine compound carried on its surface, wherein the fluorine compound is a perfluoropolyether compound or a branched polymer compound having a perfluoroalkyl group.

Incidentally, the electrophotographic member of the present invention can be used in a form of a belt or in other forms, and a suitable form can be selected freely according to the application when being used. Among them, when being used in the above described image forming apparatus, the electrophotographic member can be used in a form of a seamless belt.

The configuration of the electrophotographic member will be described while taking an electrophotographic member having a belt shape as an example.

Firstly, as for a base layer in the electrophotographic member of the present invention, the representative base layer includes a semi-electroconductive belt formed from a resin containing an electroconductive agent therein. Any of a thermosetting resin and a thermoplastic resin can be used as the resin to be used in the base layer, but polyimide, polyamide-imide, polyether ether ketone, polyphenylene sulfide or polyester is representatively used because of having high strength and high durability. These resins may be singly used or in a form of a blended or alloyed mixture, and are selected therefrom so as to be optimum according to objective characteristics such as a mechanical strength.

An electron conductive substance or an ion conductive substance can be used as the electroconductive agent. Carbon black, antimony-doped tin oxide, antimony-doped titanium oxide or an electroconductive polymer can be used as the electron conductive substance, and sodium perchlorate, lithium perchlorate, ionic surfactant of cationic surfactant or anionic surfactant, a nonionic surfactant, an oligomer having an oxyalkylene repetition unit therein or a polymer compound can be used as the ion conductive substance.

The above described base layer can have a volume resistivity of $1.0\times10^{7}$ Ω·cm or more and $1.0\times10^{12}$ Ω·cm or less. In addition, the base layer can have a surface resistivity of $1.0\times10^{8}$ Ω/sq. or more and $1.0\times10^{14}$ Ω/sq. or less. When the volume resistivity of the base layer is set in the above described range, image failures due to charge up in continuous driving and due to an insufficient transfer bias can be further decreased. In addition, when the surface resistivity of the base layer is set in the above described range, image failures due to separation discharge occurring when the transfer material S is separated from the intermediate transfer belt 7 and due to toner scattering can be further decreased. As for the above described characteristics, similar characteristics are required also to the electrical resistance of the electrophotographic member on the base layer of which the surface layer has been formed. For this reason, the surface layer of the electrophotographic member also can be semi-electroconductive. In order to adjust the volume resistivity and the surface resistivity of the surface layer, the surface layer can contain an electroconductive agent. The electroconductive agent to be used in the base layer can be similarly used.

When a thermosetting resin such as polyimide is used, for instance, the base layer can be formed as a seamless belt, by dispersing carbon black which is an electroconductive agent in a precursor of polyimide or a soluble polyimide together with a solvent to prepare a varnish, coating the dispersion liquid with the use of an apparatus such as a centrifugal molding apparatus, and baking the coating film.

The film thickness of the belt can be 30 μm or more and 150 μm or less, when being used for a transfer belt or an intermediate transfer belt.

In addition, when a thermoplastic resin is used, a semi-electroconductive pellet is prepared by mixing the carbon black which is an electroconductive agent, a resin, and an additive, as needed, and melting and kneading the mixture with a kneading unit such as a twin screw kneading apparatus. Next, a semi-electroconductive belt can be obtained by a method of melting the resin composition, and extruding the melted resin composition into a shape of a sheet, a film or a seamless belt. The resin composition can be molded by using hot press or injection molding.

In addition, a process of preparing an intermediate transfer belt such as an intermediate transfer member which is one of electrophotographic members of the present invention is not limited in particular, and may employ any manufacturing method. A method of obtaining a seamless belt includes, for instance, a method of forming a sheet by extrusion, and connecting the sheet to form a seamless belt (for instance, Japanese Patent Application Laid-Open No. H08-187773), and a method of forming an extrusion belt from a cylindrical dice (for instance, Japanese Patent Application Laid-Open No. 2001-13801). A method of extruding a resin composition from an annular lip of a spiral-shaped annular die to form a seamless body by using a melt extruder having a single-axis screw and the annular die will be described below as a manufacturing example which can be used in the present invention.

Firstly, the resin composition is charged into the melt extruder having the single-axis screw, and is extruded from the annular lip of the spiral-shaped annular die to form a seamless body. After the extrusion, the seamless body is extracted while the inner diameter is controlled by a cooling roll method or an inner cooling mandrel method, and is cut perpendicularly to an extrusion direction. Thereby, the seamless belt can be obtained. The clearance of the lip of the die can be 2.0 mm or smaller, and further can be 1.0 mm or smaller. The film thickness of the belt can be 30 μm or more and 150 μm or less for the transfer belt or the intermediate transfer belt, and can be set at a desired thickness by controlling a pulling condition when the belt is extruded from the die. The belt can be subjected to a crystallization treatment for the purpose of enhancing the mechanical strength and the durability strength. The crystallization can be promoted generally by annealing the belt at a glass transition temperature (Tg) of a resin to be used or higher. Thus obtained intermediate transfer belt is excellent in mechanical strength and durability strength. An intermediate transfer belt can be prepared which is excellent also in abrasion resistance, chemical resistance, sliding properties, toughness, and fire retardancy. When a tensile test is conducted according to JIS K 7113, for instance, it is understood that the intermediate transfer belt has an extremely excellent mechanical strength.

Incidentally, the elongation modulus of the intermediate transfer member can be 1.5 GPa or more, further can be 2.0 GPa or more, further can be 2.5 Gpa or more, and still further can be 3.0 GPa or more. In addition, the stretch at break of the intermediate transfer member can be 10% or more with reference to the length of the intermediate transfer member before being stretched, and further can be 20% or more. It is found that when satisfying this requirement, the intermediate transfer member is extremely excellent also in a point of the durability. In addition, though a method of a folding endurance test according to JIS P 8115 is known as the testing method, the intermediate transfer member of the present invention shows excellent characteristics also according to the method of the folding endurance test.

Next, the surface layer of the electrophotographic member of the present invention will be described below. The surface layer of the electrophotographic member of the present invention includes a binder resin, perfluoropolymer fine particles, a fluorocarbon resin dispersing agent and a fluorine compound, wherein the perfluoropolymer fine particle has a fluorine compound carried on its surface, wherein the fluorine compound is a perfluoropolyether compound or a branched polymer compound having a perfluoroalkyl group therein.

The binder resin to be used includes a styrene resin, an acrylic resin, a methacrylic resin, an epoxy resin, a polyester resin, a polyether resin, a silicone resin and a polyvinyl butyral resin. A mixed resin thereof also can be used. Among them, particularly the methacrylic resin or the acrylic resin (which shall be hereafter collectively referred to as acrylic-type resin) can be used, because the resin can suitably and uniformly disperse the perfluoropolymer fine particles, the fluorocarbon resin dispersing agent and the fluorine compound which constitute the surface layer of the electrophotographic member of the present invention, with a wet method. Specifically, the final surface layer is formed by: uniformly dispersing a polymerizable monomer for forming the acrylic-type resin, a solvent, the perfluoropolymer fine particles, the fluorocarbon resin dispersing agent and the fluorine compound, with a wet type dispersion device; coating the dispersion liquid on the base layer with a method such as a bar coating method and a spray coating method; drying the coated dispersion liquid to remove the solvent; and polymerizing the monomer with a curing method such as thermal cure, electron beam cure and UV cure. At this time, a polymerization initiator for polymerizing the monomer may be appropriately used. In addition to the above agent, a known additive such as the previously described electroconductive agent, an antioxidant, a leveling agent, a crosslinking agent and a fire retardant may be used by being appropriately blended. The film thickness of this surface layer can be 1 μm or more in consideration of the durability to abrasion and wear on a durability condition in an actual machine, and can be 10 μm or less in consideration of flexure resistance when the belt is suspended. The surface layer can be appropriately formed so as to have a desired film thickness by adjusting a film-forming condition (for instance, solid concentration and film-forming speed) for the film thickness of the surface layer.

Usable polymerizable monomers for forming the acrylic-type resin include: an acrylate such as pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate and bisphenol A diacrylate; and a methacrylate such as pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate and bisphenol A dimethacrylate. In addition, an oligomer such as a urethane acrylate oligomer and an epoxy acrylate oligomer having a reactive group with a molecular weight of 1,000 or more also can be used. In addition, a coating material which has been marketed can also be used.

Usable perfluoropolymer fine particles include fine particles of a polytetrafluoroethylene resin (so-called PTFE resin) and fine particles of a copolymer (so-called PFA) of tetrafluoroethylene and perfluoroalkyl vinyl ether. The products include LUBRON L-2 and L-5 made by Daikin Industries, LTD., MP1100 and MP1200 made by Du Pont-Mitsui Fluorochemicals Company, Ltd., Fluon L150J and L155J made by ASAHI GLASS CO., LTD., and SST-3 made by Shamrock Technology Inc. In the present invention, a primary particle of the perfluoropolymer fine particle can be as small as possible, and specifically the average diameter can be 5 nm or more and 1 μm or less.

In addition, in the present invention, a fluorocarbon resin dispersing agent is used in order to uniformly disperse the perfluoropolymer fine particles in the binder resin. The fluorocarbon resin dispersing agent can be an amphiphilic resin which has a site having an affinity for a perfluoroalkyl chain and a hydrocarbon, and has an amphiphilicity of fluorophilicity and fluorophobicity. Specifically, the fluorocarbon resin dispersing agent includes a surfactant, an amphiphilic block copolymer and an amphiphilic graft copolymer. Among them, the fluorocarbon resin dispersing agent can be (i) a block copolymer obtained by copolymerizing a vinyl monomer which has a fluoroalkyl group therein, with an acrylate or a methacrylate; or (ii) a comb-type graft copolymer obtained by copolymerizing an acrylate or methacrylate which has a fluoroalkyl group therein, with a macromonomer of a methacrylate having polymethyl methacrylate in its side chain. The block copolymer of the above described (i) includes MODIPER F200, F210, F2020, F600 and FT-600 made by Nippon Oil & Fats Co., Ltd., and the comb-type graft copolymer of the above described (ii) includes Aron GF-150, GF-300 and GF-400 made by Toagosei Co., Ltd., which are a fluorine-based graft polymer.

In the present invention, the fluorine compound needs to be a perfluoropolyether compound (hereinafter also referred to as PFPE) or a branched polymer compound having a perfluoroalkyl group. An oligomer or polymer which has perfluoroalkylene ether as a repeating unit therein is collectively referred to as the perfluoropolyether compound, and the perfluoropolyether compound specifically includes perfluoromethylene ether, perfluoroethylene ether and perfluoropropylene ether. In the present invention, any perfluoropolyether compound out of the above compounds can be used.

Usable PFPEs will be specifically described below. Some PFPEs are known as a fluorine oil which is an oily polymer, and usable PFPEs include specifically DEMNUM made by DAIKIN INDUSTRIES, LTD, Krytox made by DuPont, and Fomblin made by Solvay Solexis S.p.A. Among them, the usable PFPE can be a compound having high affinity with the binder resin and the perfluoropolymer fine particles of the surface layer of the electrophotographic member. Specifically, the usable PFPE includes: Fluorolink MD500, MD700, 5101X, 5113X, AD1700 and Fomblin MD40 made by Solvay Solexis S.p.A., OPTOOL DAC-HP made by DAIKIN INDUSTRIES, LTD, and KY1203 made by Shin-Etsu Chemical Co., Ltd., which are PFPE having an alkyl unit containing no fluorine in a terminal end; and Fluorolink S10 made by Solvay Solexis S.p.A., OPTOOL DAC-DSX made by DAIKIN INDUSTRIES, LTD, and KY164 and KY108 made by Shin-Etsu Chemical Co., Ltd., which are PFPE having a silyl group other than the acryl group therein.

Next, the branched polymer compound having the perfluoroalkyl group will be described below. The branched polymer compound having the perfluoroalkyl group can be a compound having high affinity with the binder resin and the perfluoropolymer fine particles of the surface layer. Specifically, the branched polymer compound includes: (a) a branched polymer compound having a trifluoromethyl group, such as HYPERTECH FA-200, FA-E-50 and FX-O12 which are a fluorine-based water repellent and oil repellent agent having a hyper-branched structure and are made by Nissan Chemical Industries, Ltd., and FTERGENT 600A and 601A which are a fluorine-based water repellent and oil repellent agent containing a hexafluoropropene oligomer and are made by NEOS COMPANY LIMITED; and (b) a branched polymer compound having a tridecafluorohexane group such as MEGAFACE F-552, F-555, F-558, RS-72-K and RS-75 made by DIC Corporation.

Generally, the PFPE and the branched polymer compound having the perfluoroalkyl group have a lower surface free energy compared to that of a fluorine resin such as tetrafluoroethylene. This is the reason why the PFPE and the branched polymer compound having the perfluoroalkyl group are characteristically used in the present invention. In other words, in the present invention, the perfluoropolymer fine particles and the fluorocarbon resin dispersing agent, and the PFPE or the branched polymer compound having the perfluoroalkyl group, which is a fluorine compound, are dispersed in the binder resin and the resultant dispersion fluid is used. Among them, the PFPE or the branched polymer compound having the perfluoroalkyl group, which has the smallest surface free energy, is preferentially arranged on the outermost surface layer in order to minimize the free energy of the outermost surface, in a film-forming process; and is easily carried on the perfluoropolymer fine particles in a form of wetting also the surface of the particles, because of having the surface free energy smaller than that of the perfluoropolymer fine particles, and having affinity interactions of fluorophobicity acting between itself and the binder resin and the fluorophilicity. The present inventors think that the two matters relate to functions and effects of the present invention. Specifically, the former is considered to act so as to lower the surface free energy of the outermost surface and affect suitable release properties and transfer properties of the toner in the secondary transfer process, in an early period when the image forming apparatus of the present invention is used. Then, the latter structure is considered to make the surface layer retain the release properties and transfer characteristics suitable for the toner, by the function of enabling the PFPE or the branched polymer compound having the perfluoroalkyl group, which is the component having the low surface free energy responsible for the suitable release properties and adequate transfer characteristics, to exist not only on the outermost surface layer of the film but also in the film; playing a role of compensating a fluorine compound such as the PFPE or the branched polymer compound having the perfluoroalkyl group on the outermost surface layer which results in dissipating when the images are repeatedly output; and making the surface layer appear which has a new PFPE or branched polymer compound having the perfluoroalkyl group, at the same time when the surface layer has dissipated.

Concerning the surface free energy of the PFPE and the branched polymer compound having the perfluoroalkyl group, such a method is generally known as to form a film containing the PFPE or the branched polymer compound having the perfluoroalkyl group, measure the contact angle using various solvents, and calculate the surface free energy from the values. The surface free energy can be calculated from the contact angle measured with the use of an automatic contact angle meter DM-501 made by Kyowa Interface Science Co., Ltd. or the like. Incidentally, according to the present inventors, the surface free energy of polytetrafluoroethylene was 23 mN/m, and the surface free energy of the copolymer of tetrafluoroethylene and perfluoroalkyl vinyl ether, which is so-called PFA, was 22 mN/m.

When being based on the above described concept, the content of the perfluoropolymer fine particles which are used in the surface layer of the electrophotographic member of the present invention can be 10 mass % or more with respect to the total solid content which forms the surface layer, further can be 20 mass % or more, and still further can be 30 mass % or more. In addition, the upper limit in a range in which the dispersibility can be suitably secured can be set at approximately 80 mass %. In addition, the content of the fluorocarbon resin dispersing agent can be 1 mass % or more and 10 mass % or less with respect to the total solid content which forms the surface layer. In addition, the content of the PFPE and the branched polymer compound having the perfluoroalkyl group can be 0.1 mass % or more and 5 mass % or less with respect to the total solid content which forms the surface layer, and further can be 0.3 mass % or more and 3 mass % or less, because it is appropriate to anticipate roughly an amount corresponding to the thickness which originates in a mechanism that is assumed to be similar to the mechanism by which a surfactant or the like forms a monomolecular layer on the outermost surface layer of a film, and an amount to be carried on the surface layer of the perfluoropolymer fine particles. Furthermore, the content of the PFPE and the branched polymer compound having the perfluoroalkyl group can be one-fifth or less by mass with reference to the perfluoropolymer fine particles, and further can be one-tenth or less, from a point that the PFPE and the branched polymer compound can wet and be carried on the perfluoropolymer fine particles.

One example of a specific method for manufacturing the electrophotographic member of the present invention will be described below.

The electrophotographic member can be manufactured by; a coating step of coating a dispersion having a polymerizable monomer, perfluoropolymer fine particles, a fluorocarbon resin dispersing agent and a fluorine compound, on a base layer; and a polymerizing step of polymerizing the polymerizable monomer to form a surface layer on the base layer.

Specifically, the dispersion is obtained by: mixing the polymerizable monomer, the perfluoropolymer fine particles, the fluorocarbon resin dispersing agent and the fluorine compound; and dispersing the particles in the monomer with a stirring type homogenizer and an ultrasonic homogenizer. The dispersion may be produced by mixing a solvent, a curing agent, an electroconductive agent and an additive together with the above compounds, at this time. Here, usable solvents include methyl ethyl ketone (MEK), methyl isobutyl ketone (MIBK) and ethylene glycol. In addition, usable curing agents include a photopolymerization initiator and a thermal polymerization initiator. In addition, usable additives include a filler particle, a colorant and a leveling agent.

The electrophotographic member of the present invention can be obtained by: coating the obtained dispersion on a belt which is the base layer with a bar coating method or a spray coating method; drying the dispersion at a temperature of 60° C. to 90° C. to remove the solvent; and then polymerizing the polymerizable monomer with heat, ultraviolet rays or an electron beam. In addition, a ring coating method also can be used as a method of coating the dispersion on the belt. As a result of having observed the cross section of this electrophotographic member with a scanning electron microscope (SEM, S-4800 made by Hitachi, Ltd.), such a state was observed that primary particles of the perfluoropolymer fine particles were dispersed in almost all faces of the cross section. Also when the PFPE has been changed to the branched polymer compound having the perfluoroalkyl group, the electrophotographic member can be manufactured with a similar method to the method of using the PFPE.

As has been described above, it is understood from the observation result with the scanning electron microscope and the above described measurement value of the surface free energy that the fluorine compound is carried on the surface of the perfluoropolymer fine particles.

Figure 2:
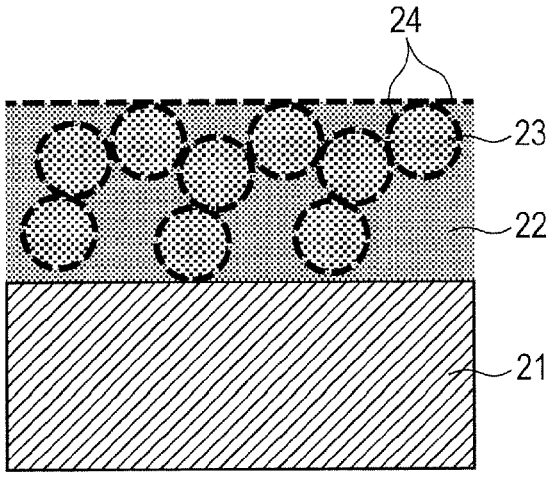
FIG. 2 is a schematic view of the cross section of an electrophotographic member of the present invention, which has been produced without being subjected to an outermost surface layer removing step.

FIG. 2 schematically illustrates the configuration of the cross section of the electrophotographic member having the surface layer obtained with the above method. In FIG. 2, a base layer 21, a binder resin 22 of the surface layer, perfluoropolymer fine particles 23 which exist in the surface layer, and a fluorine compound 24 like PFPE or a branched polymer compound having the perfluoroalkyl group are illustrated. As has been described above, in the fluorine compound, there are one which exists mainly on the outermost surface of the electrophotographic member, and another which is carried on the surface of the perfluoropolymer fine particles. Among them, there is no problem when there are not so many fluorine compounds which exist on the outermost surface. However, when the electrophotographic member which has excessively increased fluorine compounds thereon is used as the intermediate transfer member, a secondary transfer efficiency becomes adequate, but on the other hand, a phenomenon which is referred to as a so-called hollow occasionally occurs in a primary transfer process of transferring the toner from the photosensitive member to the intermediate transfer member, in an early period of printing, as is illustrated in FIG. 5B. The hollow is a phenomenon that a portion other than an outline portion of the image is not sufficiently transferred to the intermediate transfer member in the image transfer process, because the intermediate transfer member has extremely small adhesive properties to the toner.

Figure 3:
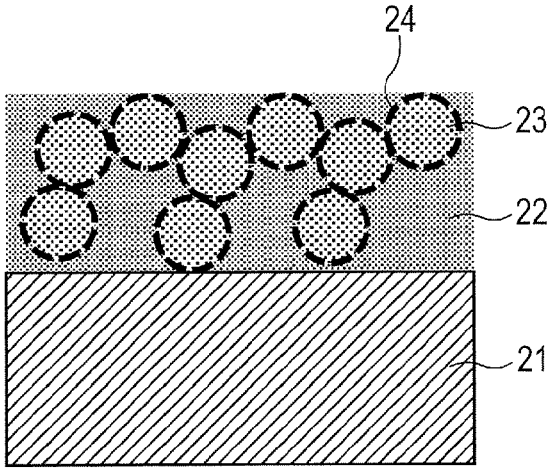
FIG. 3 is a schematic view of the cross section of an electrophotographic member of the present invention, which has been produced through the outermost surface layer removing step.

Then, as is illustrated in FIG. 3, the fluorine compound which is carried on the perfluoropolymer fine particles that exist in the inner part of the surface layer can be made to appear on the outermost surface through an outermost surface layer removing step of removing the outermost surface of the surface layer of the intermediate transfer member from the composition in FIG. 2. The thickness of the surface layer to be removed can be 20 nm or more and 2,000 nm or less from the outermost surface, and can be further 30 nm or more and 2,000 nm or less. This thickness can be a suitable amount for removing the fluorine compound that covers the outermost surface and simultaneously exposing the perfluoropolymer fine particles to the outermost surface. In this form, the fluorine compounds in a state of being carried on the perfluoropolymer fine particles result in being dotted on the outermost surface. Accordingly, the surface layer does not show extreme low adhesive properties, and can form a state in which the hollow defect in the primary transfer process is hard to occur.

Various methods which can uniformly remove the outermost surface can be employed as the method for producing such a state. Among them, the outermost surface of the surface layer can be removed by performing at least one treatment selected from the group consisting of plasma treatment, alkali treatment, and mechanical polishing treatment.

In the case of the plasma treatment, various gases such as argon, oxygen, nitrogen and carbon tetrafluoride can be used solely or in a mixed form with the other gas, and a conventional technique including a plasma generation condition such as a high-frequency power and an arc discharge can be applied to the plasma treatment. In order to suppress an unnecessary chemical change of the surface layer, the surface layer can be subjected to remote irradiation. This technique needs comparatively high cost of apparatus, but has such an advantage that the treatment can be finished only by the plasma irradiation.

In the case of the alkali treatment, the surface layer can be treated with the use of an aqueous solution of a strong alkali such as sodium hydroxide and potassium hydroxide. It is desirable to treat the surface layer at a temperature higher than a room temperature, in a point that the treatment can be finished in a short period of time. There are methods of immersing the surface layer in a treatment liquid, a method of spraying the treatment liquid to the surface layer with a spray or the like, as the operation, but any method can be used as long as the treatment condition can be controlled. After the treatment, the surface layer can be promptly washed, and can be dried by an air knife, a hot air or the like. This method is a method which can be comparatively simply performed when a method of immersing the surface layer in the treatment liquid is used.

In the case of the mechanical polishing treatment, the surface layer can be treated with the use of a buffing polishing technique which is generally used. The method of using a polishing agent can suppress the roughening of the surface compared to the method of using a wrapping film or sandpaper without using the polishing agent, and accordingly can be employed. Usable polishing agents include the one which is used in glossing or in finishing, and any of commercialized products such as a wax polishing agent and a liquid polishing agent can be used. The wax polishing agent can be used from a viewpoint that the operation is easy. After the polishing process, the surface layer is cleaned with a method such as organic solvent cleaning and pure water cleaning so as to match the type of the polishing agent, and finally, the cleaned surface layer is dried. Thus, a series of the processes can be finished. The method of removing the outermost surface layer described above can be used solely or in combination with the other method.

Figure 4:
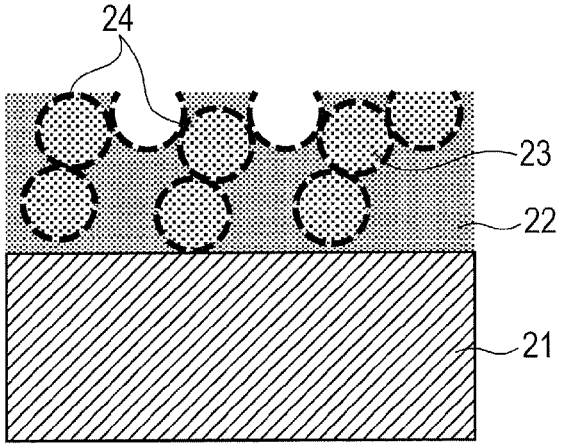
FIG. 4 is a schematic view of the cross section of an electrophotographic member of the present invention, which has repeatedly output images.

FIG. 4 is a schematic view of the configuration of the cross section of a semi-electroconductive film having the surface layer according to the present invention, after images have been repeatedly output. As is illustrated in this figure, even when the surface of the surface layer is abraded by an electric discharge due to an high voltage which has been applied in the transfer process, the cleaning process and the like, the fluorine compound which is carried on the perfluoropolymer fine particles results in being supplied to the outermost surface. In other words, the component having the low surface free energy, which affects suitable release properties and transfer characteristics of the toner in the secondary transfer process, newly appears simultaneously with the dissipation of the surface portion of the surface layer, and thereby a structure is achieved which retains the suitable release properties and the transfer characteristics for the toner.

The electrophotographic member of the present invention, which is formed in this way, has excellent transfer characteristics in an early period, and has the excellent transfer characteristics also after having repeatedly output images. The above described characteristics are proved by evaluating the characteristics with an actual image forming apparatus. In the Examples which will be described below, an image output from a commercial image forming apparatus which used the electrophotographic member of the present invention therein was evaluated.

Incidentally, one example which can be used for the electrophotographic member of the present invention is the above described intermediate transfer member, but the electrophotographic member of the present invention is not limited only to the intermediate transfer member.

EXAMPLES

Example 1

An electrophotographic member of the present invention was produced by using an intermediate transfer belt made from polyimide, which was equipped in iRC2620 made by Canon Inc. as a base layer, and forming a surface layer by applying a dispersion liquid shown below onto this base layer with a ring coat method. For information, Table 1 shows volume resistance values, surface resistance values and evaluation results of respective intermediate transfer belts of Examples 1-1 to 1-7 and Comparative Examples 1-1 to 1-3, and Table 2 shows volume resistance values, surface resistance values and evaluation results of respective intermediate transfer belts of Examples 1-8 and 1-9, and Comparative Examples 1-4 to 1-6. Incidentally, any of the volume resistance values and the surface resistance values of the intermediate transfer belts which were produced in the Examples was measured with Hiresta made by Mitsubishi Chemical Corporation.

Example 1-1

Dipentaerythritol hexaacrylate: 8 parts by mass
Pentaerythritol tetraacrylate: 17 parts by mass
Pentaerythritol triacrylate: 5 parts by mass
Methyl ethyl ketone: 43 parts by mass
Ethylene glycol: 15 parts by mass
Antimony-doped tin-oxide fine particle (ISHIHARA SANGYO KAISHA, LTD. SN series): 4 parts by mass Photopolymerization initiator (IRGACURE 184): 2 parts by mass Tetrafluoroethylene fine particle (LUBRON L-2 made by DAIKIN INDUSTRIES, LTD, with average diameter of primary particles of approximately 0.3 μm): 15 parts by mass Fluorocarbon resin dispersing agent (GF-300 made by Toagosei Co., Ltd.): 1 part by mass PFPE (MD500 made by Solvay Solexis S.p.A.): 0.4 parts by mass These compounds were mixed and dispersed by a stirring type homogenizer, and then were dispersed by a dispersion device Nanomizer (made by YOSHIDA KIKAI CO., LTD.) to form a mixture dispersion liquid. The mixture dispersion liquid was coated onto the above described base layer made from polyimide, the coated liquid was dried for 3 minutes at 70° C., and then the coated film was irradiated with the ultraviolet light having a wavelength of 365 nm and an intensity of 500 mJ/cm$^2$ by using a high pressure mercury lamp. Thereby, the resin was cured, and an intermediate transfer belt 1-1 was obtained which had a surface layer thereon with a film thickness of 4 μm.

<Image Evaluation>

This intermediate transfer belt 1-1 which was the electrophotographic member was attached to an apparatus iRC2620 made by Canon Inc., instead of the intermediate transfer belt made from polyimide equipped in the apparatus, and the image was evaluated. At this time, plain paper 4024 made by Xerox Corporation was used as a paper of a transfer material. The evaluation results are shown in Table 1. Incidentally, a blue image was output for the evaluation. By visual evaluation, an image was evaluated as A when the image had little image unevenness and was excellent, an image was evaluated as B when the image had quality which followed to the image evaluated as A, an image was evaluated as C when the image had a portion of which the transfer was not sufficient in some places, and an image was evaluated as D when the image was worse than the image evaluated as C.

Example 1-2

An intermediate transfer belt 1-2 was obtained by being produced in a similar way to that of Example 1-1 except that dipentaerythritol hexaacrylate was not used, the amount of pentaerythritol tetraacrylate was changed to 27 parts by mass from 17 parts by mass, and the amount of pentaerythritol triacrylate was changed to 3 parts by mass from 5 parts by mass, in Example 1-1.

In addition, images were evaluated in a similar way to that in Example 1 by using the intermediate transfer belt 1-2 instead of using the intermediate transfer belt 1-1. The evaluation results are shown in Table 1.

Example 1-3

An intermediate transfer belt 1-3 was obtained by being produced in a similar way to that of Example 1-1 except that the amount of tetrafluoroethylene fine particles (LUBRON L-2 made by DAIKIN INDUSTRIES, LTD) was changed to 20 parts by mass, and the amount of PFPE (MD500 made by Solvay Solexis S.p.A.) was changed to 0.6 parts by mass, in Example 1-1.

In addition, images were evaluated in a similar way to that in Example 1-1 by using the intermediate transfer belt 1-3 instead of using the intermediate transfer belt 1-1. The evaluation results are shown in Table 1.

Example 1-4

An intermediate transfer belt 1-4 was obtained by being produced in a similar way to that of Example 1-2 except that PFPE (MD500 made by Solvay Solexis S.p.A.) was changed to PFPE (MD700 made by Solvay Solexis S.p.A.) in Example 1-2.

In addition, images were evaluated in a similar way to that in Example 1-1 by using the intermediate transfer belt 1-4 instead of using the intermediate transfer belt 1-1. The evaluation results are shown in Table 1.

Example 1-5

An intermediate transfer belt 1-5 was obtained by being produced in a similar way to that of Example 1-1 except that 0.3 parts by mass of PFPE (OPTOOL DAC made by DAIKIN INDUSTRIES, LTD) was added instead of 0.4 parts by mass of PFPE (MD500 made by Solvay Solexis S.p.A.) in Example 1-1.

In addition, images were evaluated in a similar way to that in Example 1-1 by using the intermediate transfer belt 1-5 instead of using the intermediate transfer belt 1-1. The evaluation results are shown in Table 1.

Example 1-6

An intermediate transfer belt 1-6 was obtained by being produced in a similar way to that of Example 1-1 except that the amount of tetrafluoroethylene fine particles (LUBRON L-2 made by DAIKIN INDUSTRIES, LTD) was changed to 30 parts by mass from 15 parts by mass, and the amount of PFPE (MD500 made by Solvay Solexis S.p.A.) was changed to 0.6 parts by mass from 0.4 parts by mass, in Example 1-1.

In addition, images were evaluated in a similar way to that in Example 1-1 by using the intermediate transfer belt 1-6 instead of using the intermediate transfer belt 1-1. The evaluation results are shown in Table 1.

Example 1-7

An intermediate transfer belt 7 was obtained by being produced in a similar way to that of Example 1-2 except that the amount of tetrafluoroethylene fine particles (LUBRON L-2 made by DAIKIN INDUSTRIES, LTD) was changed to 10 parts by mass from 15 parts by mass, and the amount of PFPE (MD500 made by Solvay Solexis S.p.A.) was changed to 0.6 parts by mass from 0.4 parts by mass, in Example 1-2.

In addition, images were evaluated in a similar way to that in Example 1-1 by using the intermediate transfer belt 1-7 instead of using the intermediate transfer belt 1-1. The evaluation results are shown in Table 1.

Comparative Example 1-1

In Example 1-1, dipentaerythritol hexaacrylate was not used, and the amount of pentaerythritol tetraacrylate was changed to 25 parts by mass from 17 parts by mass. In addition, GF300 and the tetrafluoroethylene fine particle were not used. An intermediate transfer belt 1-8 was obtained by being produced in a similar way to that of Example 1-1 except for the above conditions.

In addition, images were evaluated in a similar way to that in Example 1-1 by using the intermediate transfer belt 1-8 instead of using the intermediate transfer belt 1-1. The evaluation results are shown in Table 1.

Comparative Example 1-2

An intermediate transfer belt 1-9 was obtained by being produced in a similar way to that of Comparative Example 1-1 except that the amount of PFPE (MD500 made by Solvay Solexis S.p.A.) was changed to 2.5 parts by mass from 0.4 parts by mass, in Comparative Example 1-1.

In addition, images were evaluated in a similar way to that in Example 1-1 by using the intermediate transfer belt 1-9 instead of using the intermediate transfer belt 1-1. The evaluation results are shown in Table 1.

Comparative Example 1-3

An intermediate transfer belt 1-10 was obtained by being produced in a similar way to that of Comparative Example 1-1 except that the amount of pentaerythritol tetraacrylate was changed to 27 parts by mass from 25 parts by mass, the amount of pentaerythritol triacrylate was changed to 3 parts by mass from 5 parts by mass, 0.3 parts by mass of poly (phenyl methyl siloxane), which is a silicon-based leveling agent, was added, and the film thickness of the surface layer was changed to 3 μm from 4 μm, in Comparative Example 1.

In addition, images were evaluated in a similar way to that in Example 1-1 by using the intermediate transfer belt 1-10 instead of using the intermediate transfer belt 1-1. The evaluation results are shown in Table 1.

TABLE 1

| | Intermediate transfer member | Volume resistance value (Ω · cm) | Surface resistance value (Ω/sq.) | Right after start | After 3,000 sheets | After 30,000 sheets |
|---|---|---|---|---|---|---|
| Example 1-1 | Intermediate transfer belt 1-1 | $1.2 \times 10^{11}$ | $6.4 \times 10^{12}$ | A | A | A |
| Example 1-2 | Intermediate transfer belt 1-2 | $2.2 \times 10^{11}$ | $6.9 \times 10^{12}$ | A | A | A |
| Example 1-3 | Intermediate transfer belt 1-3 | $1.8 \times 10^{11}$ | $8.2 \times 10^{12}$ | A | A | A |
| Example 1-4 | Intermediate transfer belt 1-4 | $2.1 \times 10^{11}$ | $7.2 \times 10^{12}$ | A | A | A |
| Example 1-5 | Intermediate transfer belt 1-5 | $1.1 \times 10^{11}$ | $6.2 \times 10^{12}$ | A | A | B |
| Example 1-6 | Intermediate transfer belt 1-6 | $3.1 \times 10^{11}$ | $2.2 \times 10^{12}$ | A | A | A |
| Example 1-7 | Intermediate transfer belt 1-7 | $7.1 \times 10^{10}$ | $8.6 \times 10^{11}$ | A | B | B |
| Comparative Example 1-1 | Intermediate transfer belt 1-8 | $4.2 \times 10^{10}$ | $1.4 \times 10^{12}$ | A | D | — |
| Comparative Example 1-2 | Intermediate transfer belt 1-9 | $4.2 \times 10^{10}$ | $1.4 \times 10^{12}$ | A | D | — |
| Comparative Example 1-3 | Intermediate transfer belt 1-10 | $3.2 \times 10^{11}$ | $7.4 \times 10^{12}$ | D | — | — |

Example 1-8

An intermediate transfer belt 1-11 was obtained by being produced in a similar way to that of Example 1-1 except that a fluorocarbon resin dispersing agent was not used, and PFPE was changed to a terminal-fluorinated dendritic polymer particle (HYPERTECH FA-200 made by Nissan Chemical Industries, Ltd.), in Example 1-1.

In addition, images were evaluated in a similar way to that in Example 1-1 by using the intermediate transfer belt 1-11 instead of using the intermediate transfer belt 1-1. The evaluation results are shown in Table 2.

Example 1-9

An intermediate transfer belt 1-12 was obtained by being produced in a similar way to that of Example 8 except that dipentaerythritol hexaacrylate was not used, the amount of pentaerythritol tetraacrylate was changed to 27 parts by mass from 17 parts by mass, and the amount of pentaerythritol triacrylate was changed to 3 parts by mass from 5 parts by mass, in Example 1-8.

In addition, images were evaluated in a similar way to that in Example 1-1 by using the intermediate transfer belt 1-12 instead of using the intermediate transfer belt 1-1. The evaluation results are shown in Table 2.

Comparative Example 1-4

An intermediate transfer belt 1-13 was obtained by being produced in a similar way to that of Example 1-8 except that dipentaerythritol hexaacrylate was not used, the amount of pentaerythritol tetraacrylate was changed to 25 parts by mass from 17 parts by mass, and GF300 and the tetrafluoroethylene fine particle were not used, in Example 1-8.

In addition, images were evaluated in a similar way to that in Example 1-1 by using the intermediate transfer belt 1-13 instead of using the intermediate transfer belt 1-1. The evaluation results are shown in Table 2.

Comparative Example 1-5

An intermediate transfer belt 1-14 was obtained by being produced in a similar way to that of Comparative Example 1-4 except that the amount of terminal-fluorinated dendritic polymer particles (HYPERTECH FA-200 made by Nissan Chemical Industries, Ltd.) of Comparative Example 1-4 was changed to 2.5 parts by mass from 0.4 parts by mass.

In addition, images were evaluated in a similar way to that in Example 1-1 by using the intermediate transfer belt 1-14 instead of using the intermediate transfer belt 1-1. The evaluation results are shown in Table 2.

Comparative Example 1-6

An intermediate transfer belt 1-15 was obtained by being produced in a similar way to that of Example 1-8 except that the terminal-fluorinated dendritic polymer particle (HYPERTECH FA-200 made by Nissan Chemical Industries, Ltd.) was not used, dipentaerythritol hexaacrylate was not used, the amount of pentaerythritol tetraacrylate was changed to 27 parts by mass from 17 parts by mass, the amount of pentaerythritol triacrylate was changed to 3 parts by mass from 5 parts by mass, 1 part by mass of a fluorocarbon resin dispersing agent (GF-300 made by Toagosei Co., Ltd.) was added, and 0.3 parts by mass of poly(phenyl methyl siloxane), which is a silicon-based leveling agent, was added in Example 1-8.

In addition, images were evaluated in a similar way to that in Example 1-1 by using the intermediate transfer belt 1-15 instead of using the intermediate transfer belt 1-1. The evaluation results are shown in Table 2.

TABLE 2

| | Intermediate transfer member | Volume resistance value (Ω · cm) | Surface resistance value (Ω/sq.) | Right after start | After 3,000 sheets | After 30,000 sheets |
|---|---|---|---|---|---|---|
| Example 1-8 | Intermediate transfer belt 1-11 | $1.2 \times 10^{11}$ | $6.4 \times 10^{12}$ | A | A | A |
| Example 1-9 | Intermediate transfer belt 1-12 | $2.2 \times 10^{11}$ | $6.9 \times 10^{12}$ | A | A | A |
| Comparative Example 1-4 | Intermediate transfer belt 1-13 | $4.2 \times 10^{11}$ | $3.7 \times 10^{12}$ | A | D | — |
| Comparative Example 1-5 | Intermediate transfer belt 1-14 | $1.1 \times 10^{10}$ | $2.9 \times 10^{11}$ | A | D | — |
| Comparative Example 1-6 | Intermediate transfer belt 1-15 | $3.2 \times 10^{11}$ | $7.4 \times 10^{12}$ | D | — | — |

Example 2

Example 2-1

The following materials were prepared.

Dipentaerythritol hexaacrylate: 8 parts by mass
Pentaerythritol tetraacrylate: 17 parts by mass
Pentaerythritol triacrylate: 5 parts by mass
Methyl ethyl ketone: 43 parts by mass
Ethylene glycol: 15 parts by mass
Antimony-doped tin-oxide fine particle (ISHIHARA SANGYO KAISHA, LTD. SN series (trade name)): 4 parts by mass
IRGACURE 184 (trade name: made by TOYOTSU CHEMIPLAS CORPORATION): 2 parts by mass
Polytetrafluoroethylene fine particle with an average diameter of primary particles of approximately 0.3 μm (LUBRON L-2 (trade name) made by DAIKIN INDUSTRIES, LTD): 16 parts by mass
GF-300 (trade name) made by Toagosei Co., Ltd.: 1 part by mass
Acryl-modified PFPE (trade name: MD500, made by Solvay Solexis S.p.A.): 0.6 parts by mass The above described materials were mixed and dispersed by a stirring type homogenizer, and then were dispersed by a dispersion device (trade name: Nanomizer, made by YOSHIDA KIKAI CO., LTD.) to form a mixture dispersion liquid.

Next, the above described intermediate transfer belt which was made from polyether ether ketone resin and was equipped in iR-ADV C2030 made by Canon Inc. was cut out into a size A4, and this film was used as a base layer.

The above described mixture dispersion liquid was coated onto this base layer, the coated liquid was dried for 3 minutes at the temperature of 70° C., then the dried film was cured with an ultraviolet light of 500 mJ/cm$^2$, and a coating film (surface layer before outermost surface layer removal) with a film thickness of 4 μm was obtained. A workpiece obtained in this stage, which has the coating film formed on the base layer, is hereinafter referred to as "film provided with coating film."

Next, plasma was generated in a microwave plasma device (M120W (trade name) made by Nissin Inc.) from a mixed gas of 5% by volume of carbon tetrafluoride and oxygen, and the workpiece was irradiated with only a neutral radical by performing remote irradiation. Thus, the surface of the above described coating film was uniformly etched by 100 nm, and an intermediate transfer belt 2-1 was obtained.

The intermediate transfer belt 2-1 had a volume resistance value of $2.1 \times 10^{11}$ Ω·cm and a surface resistance value of $8.6 \times 10^{12}$ Ω/sq. The resistance value was measured by connecting a URS probe to Hiresta (trade name) made by Mitsubishi Chemical Corporation, and a value measured when 30 seconds passed after 100V had been applied was determined to be a measurement value.

This intermediate transfer belt 2-1 was worked as follows. The center part of the intermediate transfer belt A used in iR-ADV C2030 made by Canon Inc. was cut out into a size of 5 cm×5 cm. Next, this intermediate transfer belt 2-1 was cut into the same shape as the portion cut out from the intermediate transfer belt A, was fit in a hole part from which the above described intermediate transfer belt A was cut out, and was stuck with an adhesive tape made from Teflon (registered trademark) resin. Thus, the intermediate transfer belt to be used for the test was prepared. An image at the portion corresponding to the fit intermediate transfer belt 2-1 was evaluated by using thus worked intermediate transfer belt for the test. Plain paper 4024 (trade name) which tended to be inferior in the quality of a transfer image made by Xerox Corporation was used as a paper of a transfer material, and the uniformity of the image and a hollow defect were evaluated for confirming the grade of the image.

The uniformity of the image was evaluated according to the following criteria, after a blue solid image was output and the output image was visually observed.

A: there is almost no unevenness and the like.
B: the unevenness is classified to a level following to A.
C: the transfer is not sufficient and a portion which is not blue is observed.
D: a portion which is not blue is noticeable.

The belt of the present Example 2-1 was evaluated, and the evaluation result of the uniformity of the image was A right after the evaluation was started, the evaluation result was A after 10,000 sheets were printed, and the evaluation result was also A after 100,000 sheets were printed.

Figure 5A:
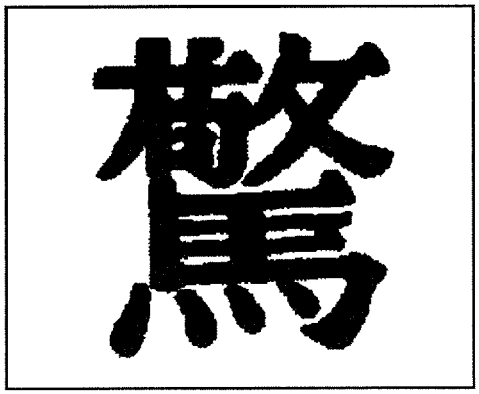
FIGS. 5A and 5B are schematic views for describing a hollow phenomenon.
Figure 5B:
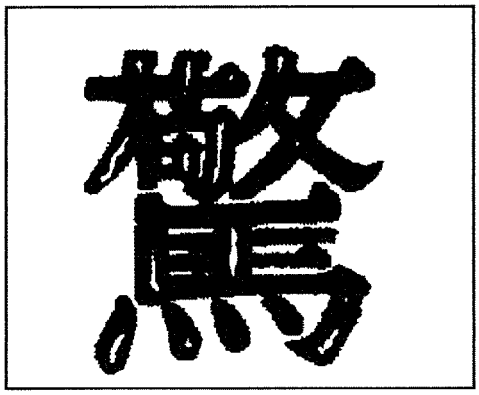

The hollow defect (state of FIG. 5B) of a character when a character pattern of "kanji of surprise" illustrated in FIG. 5A was printed on the above described paper was visually observed based on the following criteria, and the transfer hollow defect was evaluated based on the following criteria.

A: a hollow defect does not almost occur.
B: a slight hollow defect can be observed.

C: a hollow defect can be observed.

D: a remarkable hollow defect can be observed.

The belt of the present Example 2-1 was evaluated, and the evaluation result of the transfer hollow defect was A right after the evaluation was started, the evaluation result was A after 10,000 sheets were printed, and the evaluation result was also A after 100,000 sheets were printed.

Example 2-2

A film provided with a coating film which has the outermost surface having low surface energy was prepared in a similar way to that in Example 2-1. Next, 3 mass % of an aqueous solution of sodium hydroxide was used as an alkaline treatment liquid and was heated to 70° C. The prepared film was immersed into this aqueous solution, thereby the surface of the film provided with the coating film was uniformly etched, and an intermediate transfer belt 2-2 was obtained. As a result of having had measured the resistance in a similar way to that in Example 2-1, the volume resistance value was $2.4\times10^{11}$ Ω·cm and the surface resistance value was $8.8\times10^{12}$ Ω/sq. Images were evaluated with a similar method to that in Example 2-1 with the use of this intermediate transfer belt 2-2.

The uniformity of the image was evaluated to be A right after the evaluation started, to be A after 10,000 sheets were printed, and to be also A after 100,000 sheets were printed. The hollow defect was evaluated to be A right after the evaluation started, to be A after 10,000 sheets were printed, and to be also A after 100,000 sheets were printed.

Example 2-3

A film provided with a coating film which has the outermost surface having low surface energy was prepared in a similar way to that in Example 2-1. Next, the surface of the film was uniformly ground by being buffed with the use of PIKAL Metal Polish Paste Type (trade name: made by Nihon Maryo-Kogyo Co., Ltd.) which is an abrasive, then the remaining abrasive was removed by being washed with an organic solvent, and an intermediate transfer belt 2-3 was obtained. As a result of having had measured the resistance in a similar way to that in Example 2-1, the volume resistance value was $1.9\times10^{11}$ Ω·cm and the surface resistance value was $8.3\times10^{12}$ Ω/sq. Images were evaluated with a similar method to that in Example 2-1 with the use of this intermediate transfer belt 2-3.

The uniformity of the image was evaluated to be A right after the evaluation started, to be A after 10,000 sheets were printed, and to be also A after 100,000 sheets were printed. The hollow defect was evaluated to be A right after the evaluation started, to be A after 10,000 sheets were printed, and to be also A after 100,000 sheets were printed.

Example 2-4

An acryl-modified terminal-fluorinated dendritic polymer particle (HYPERTECH FA-200 (trade name) made by Nissan Chemical Industries, Ltd.) was used instead of acryl-modified PFPE MD500 made by Solvay Solexis S.p.A. (the amount to be used was the same). A film provided with a coating film which has the outermost surface having low surface energy was prepared in a similar way to that in Example 1 except for the above condition. Next, the surface of the film was uniformly etched with similar plasma treatment to that in Example 1, and an intermediate transfer belt 2-4 was obtained. As a result of having had measured the resistance in a similar way to that in Example 2-1, the volume resistance value was $2.5\times10^{11}$ Ω·cm and the surface resistance value was $8.7\times10^{12}$ Ω/sq. Images were evaluated with a similar method to that in Example 2-1 with the use of this intermediate transfer belt 2-4. The uniformity of the image was evaluated to be A right after the evaluation started, to be A after 10,000 sheets were printed, and to be also A after 100,000 sheets were printed. The hollow defect was evaluated to be A right after the evaluation started, to be A after 10,000 sheets were printed, and to be also A after 100,000 sheets were printed.

Example 2-5

A film provided with a coating film which has the outermost surface having low surface energy was prepared in a similar way to that in Example 2-4. Next, the surface of the film was uniformly etched with similar alkali treatment to that in Example 2-2, and an intermediate transfer belt 2-5 was obtained. As a result of having had measured the resistance in a similar way to that in Example 2-1, the volume resistance value was $2.3\times10^{11}$ Ω·cm and the surface resistance value was $8.9\times10^{12}$ Ω/sq. Images were evaluated with a similar method to that in Example 2-1 with the use of this intermediate transfer belt 2-5. The uniformity of the image was evaluated to be A right after the evaluation started, to be A after 10,000 sheets were printed, and to be also A after 100,000 sheets were printed. The hollow defect was evaluated to be A right after the evaluation started, to be A after 10,000 sheets were printed, and to be also A after 100,000 sheets were printed.

Example 2-6

A film provided with a coating film which has the outermost surface having low surface energy was prepared in a similar way to that in Example 2-4. Next, the surface of the film was uniformly ground with similar mechanical polishing treatment to that in Example 3, and an intermediate transfer belt 2-6 was obtained. As a result of having had measured the resistance in a similar way to that in Example 2-1, the volume resistance value was $2.0\times10^{11}$ Ω·cm and the surface resistance value was $8.4\times10^{12}$ Ω/sq. Images were evaluated with a similar method to that in Example 2-1 with the use of this intermediate transfer belt 2-6.

The uniformity of the image was evaluated to be A right after the evaluation started, to be A after 10,000 sheets were printed, and to be also A after 100,000 sheets were printed. The hollow defect was evaluated to be A right after the evaluation started, to be A after 10,000 sheets were printed, and to be also A after 100,000 sheets were printed.

Comparative Example 2-1

A film provided with a coating film was obtained in a similar way to that in Example 2-1, and was used in the state as an intermediate transfer belt 2-7. As a result of having had measured the resistance in a similar way to that in Example 2-1, the volume resistance value was $1.8\times10^{11}$ Ω·cm and the surface resistance value was $8.2\times10^{12}$ Ω/sq. Images were evaluated with a similar method to that in Example 2-1 with the use of this intermediate transfer belt 2-7.

The uniformity of the image was evaluated to be A right after the evaluation started, to be A after 10,000 sheets were printed, and to be also A after 100,000 sheets were printed. The hollow defect was evaluated to be C right after the evaluation started, to be A after 10,000 sheets were printed, and to be also A after 100,000 sheets were printed.

Comparative Example 2-2

A polytetrafluoroethylene fine particle "LUBRON L-2" and a dispersion resin "GF-300" were not used as materials of the surface layer. A film provided with a coating film was obtained in a similar way to that in Example 2-1 except for the above condition, and was used in the state as an intermediate transfer belt 2-8. As a result of having had measured the resistance in a similar way to that in Example 2-1, the volume resistance value was $1.2\times10^{11}$ Ω·cm and the surface resistance value was $7.9\times10^{12}$ Ω/sq. Images were evaluated with a similar method to that in Example 2-1 with the use of this intermediate transfer belt 2-8.

The uniformity of the image was evaluated to be A right after the evaluation started, to be D after 10,000 sheets were printed, and to be also D after 100,000 sheets were printed. The hollow defect was evaluated to be C right after the evaluation started, to be A after 10,000 sheets were printed, and to be also A after 100,000 sheets were printed.

Comparative Example 2-3

Acryl-modified PFPE "MD500" was not used as a material of the surface layer, and 0.3 parts by mass of poly(phenyl methyl siloxane), which is a silicone-based leveling agent, was used instead. The thickness of the surface layer was set at 3 μm. A film provided with a coating film was obtained in a similar way to that in Example 2-1 except for the above condition, and was used in the state as an intermediate transfer belt 2-9. As a result of having had measured the resistance in a similar way to that in Example 2-1, the volume resistance value was $3.2\times10^{11}$ Ω·cm and the surface resistance value was $7.4\times10^{12}$ Ω/sq. Images were evaluated with a similar method to that in Example 2-1 with the use of this intermediate transfer belt 2-9.

The uniformity of the image was evaluated to be D right after the evaluation started, to be D after 10,000 sheets were printed, and to be also D after 100,000 sheets were printed. The hollow defect was evaluated to be A right after the evaluation started, to be A after 10,000 sheets were printed, and to be also A after 100,000 sheets were printed.

Example 3

An electrophotographic member of the present invention was produced with the use of an intermediate transfer belt made from polyimide, which was equipped in iRC2620 made by Canon Inc. as a base layer, and forming a surface layer by applying a dispersion liquid shown below onto this base layer. For information, Table 3 shows respective evaluation results of Examples 3-1 to 3-7 and Comparative Examples 3-1 to 3-3, and Table 4 shows respective evaluation results of Examples 3-8 and 3-9, and Comparative Examples 3-4 to 3-6.

Example 3-1

Dipentaerythritol hexaacrylate: 8 parts by mass
Pentaerythritol tetraacrylate: 17 parts by mass
Pentaerythritol triacrylate: 5 parts by mass
Methyl ethyl ketone: 43 parts by mass
Ethylene glycol: 15 parts by mass
Antimony-doped tin-oxide fine particle (SN100P made by ISHIHARA SANGYO KAISHA, LTD.): 4 parts by mass
IRGACURE 184 (photopolymerization initiator): 2 parts by mass
Tetrafluoroethylene fine particle (LUBRON L-2 made by DAIKIN INDUSTRIES, LTD, with average diameter of primary particles of approximately 0.3 μm): 15 parts by mass
Dispersing agent for tetrafluoroethylene fine particle (Aron GF-300 made by Toagosei Co., Ltd.): 1 part by mass PFPE (Fluorolink MD500 made by Solvay Solexis S.p.A.): 0.4 parts by mass These compounds were mixed and dispersed by a stirring type homogenizer, and then were dispersed by a dispersion device Nanomizer (made by YOSHIDA KIKAI CO., LTD.) to form a mixture dispersion liquid. The mixture dispersion liquid was coated onto the above described base layer made from polyimide, the coated liquid was dried for 3 minutes at 70° C., and then the coated film was irradiated with the ultraviolet light having a wavelength of 365 nm and an intensity of 1,000 mJ/cm$^2$ by using a high pressure mercury lamp. Thereby, the resin was cured, and an intermediate transfer belt 3-1 was obtained which had a surface layer thereon with a film thickness of 4 μm. The intermediate transfer belt 3-1 had a volume resistance value of $5.1\times10^{9}$ Ω·cm and a surface resistance value of $9.2\times10^{10}$ Ω/sq. (which were measured with Hiresta UP made by Mitsubishi Chemical Analytech Co., Ltd.).

<Image Evaluation>

This intermediate transfer belt 3-1 which was the electrophotographic member was attached to an apparatus iRC2620 made by Canon Inc., instead of the intermediate transfer belt made from polyimide equipped in the apparatus, and the image was evaluated. At this time, plain paper 4024 made by Xerox Corporation was used as a paper of a recording medium. The evaluation results are shown in Table 3. Incidentally, a blue image was output for the evaluation. By visual evaluation, an image was evaluated as A when the image had little unevenness and was excellent, an image was evaluated as B when the image had quality which followed to the image evaluated as A, an image was evaluated as C when the image had a portion of which the transfer was not sufficient and was not blue in some places, and an image was evaluated as D when the image was worse than the image evaluated as C.

Example 3-2

An intermediate transfer belt 3-2 was obtained by being produced in a similar way to that of Example 3-1 except that PFPE which was a water and oil repellent agent was changed to Fluorolink MD700 in Example 3-1. The intermediate transfer belt 2 had a volume resistance value of $5.7\times10^{9}$ Ω·cm and a surface resistance value of $4.8\times10^{11}$ Ω/sq. (which were measured with Hiresta made by Mitsubishi Chemical Analytech Co., Ltd.).

In addition, images were evaluated in a similar way to that in Example 3-1. The evaluation results are shown in Table 1.

Example 3-3

An intermediate transfer belt 3-3 was obtained by being produced in a similar way to that of Example 3-1 except that PFPE which was the water and oil repellent agent was changed to Fomblin MD40 in Example 3-1. The intermediate transfer belt 3-3 had a volume resistance value of $2.5\times10^{9}$ Ω·cm and a surface resistance value of $4.5\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-4

An intermediate transfer belt 3-4 was obtained by being produced in a similar way to that of Example 3-1 except that the water and oil repellent agent was changed to OPTOOL DAC and OPTOOL DAC was added so that an effective component thereof became 0.4 parts by mass in Example 3-1. The intermediate transfer belt 3-4 had a volume resistance value of $2.6\times10^{9}$ Ω·cm and a surface resistance value of $3.5\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-5

An intermediate transfer belt 3-5 was obtained by being produced in a similar way to that of Example 3-1 except that the water and oil repellent agent was changed to HYPERTECH FA-200 in Example 3-1. The intermediate transfer belt 3-5 had a volume resistance value of $4.0\times10^{9}$ Ω·cm and a surface resistance value of $3.8\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-6

An intermediate transfer belt 3-6 was obtained by being produced in a similar way to that of Example 3-1 except that the water and oil repellent agent was changed to FTERGENT 600A in Example 3-1. The intermediate transfer belt 3-6 had a volume resistance value of $5.6\times10^{9}$ Ω·cm and a surface resistance value of $4.6\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-7

An intermediate transfer belt 3-7 was obtained by being produced in a similar way to that of Example 3-1 except that the water and oil repellent was changed to MEGAFACE F555 in Example 3-1. The intermediate transfer belt 3-7 had a volume resistance value of $7.2\times10^{9}$ Ω·cm and a surface resistance value of $1.1\times10^{11}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-8

An intermediate transfer belt 3-8 was obtained by being produced in a similar way to that of Example 3-1 except that the amount of tetrafluoroethylene fine particles (LUBRON L-2 made by DAIKIN INDUSTRIES, LTD) was changed to 25 parts by mass from 15 parts by mass, and the amount of PFPE (Fluorolink MD500 made by Solvay Solexis S.p.A.) was changed to 0.6 parts by mass from 0.4 parts by mass, in Example 3-1. The intermediate transfer belt 3-8 had a volume resistance value of $3.6\times10^{9}$ Ω·cm and a surface resistance value of $2.2\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-9

An intermediate transfer belt 3-9 was obtained by being produced in a similar way to that of Example 3-1 except that the amount of tetrafluoroethylene fine particles (LUBRON L-2 made by DAIKIN INDUSTRIES, LTD) was changed to 42 parts by mass from 15 parts by mass, the amount of PFPE (Fluorolink MD500 made by Solvay Solexis S.p.A.) was changed to 0.6 parts by mass from 0.4 parts by mass, and the amount of Aron GF-300 was changed to 2 parts by mass from 1 part by mass, in Example 3-1. The intermediate transfer belt 3-9 had a volume resistance value of $5.4\times10^{9}$ Ω·cm and a surface resistance value of $6.9\times10^{10}$ Ω/sq. (which were measured with Hiresta made by Mitsubishi Chemical Analytech Co., Ltd.). In addition, images were evaluated in a similar way to that in Example 1. The evaluation results are shown in Table 3.

Example 3-10

An intermediate transfer belt 3-10 was obtained by being produced in a similar way to that of Example 3-1 except that the amount of tetrafluoroethylene fine particles (LUBRON L-2 made by DAIKIN INDUSTRIES, LTD) was changed to 10 parts by mass from 15 parts by mass, and the amount of PFPE (Fluorolink MD500 made by Solvay Solexis S.p.A.) was changed to 0.6 parts by mass from 0.4 parts by mass, in Example 3-1. The intermediate transfer belt 3-10 had a volume resistance value of $5.5\times10^{9}$ Ω·cm and a surface resistance value of $1.0\times10^{11}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-11

An intermediate transfer belt 3-11 was obtained by being produced in a similar way to that of Example 3-1 except that the dispersing agent was changed to MODIPER FT-600 in Example 3-1. The intermediate transfer belt 3-11 had a volume resistance value of $3.8\times10^{9}$ Ω·cm and a surface resistance value of $4.1\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 3.

Example 3-12

An intermediate transfer belt 3-12 was obtained by being produced in a similar way to that of Example 3-1 except that dipentaerythritol hexaacrylate and pentaerythritol triacrylate were not used, and pentaerythritol tetraacrylate was changed to urethane acrylate monomer U-4HA (made by Shin Nakamura Chemical Co., Ltd., with molecular weight of 600 and number of functional groups of 4) in an amount of 30 parts by mass, in Example 3-1. The intermediate transfer belt 3-12 had a volume resistance value of $1.1\times10^{9}$ Ω·cm and a surface resistance value of $7.4\times10^{11}$ Ω/sq. (which were measured with Hiresta made by Mitsubishi Chemical Analytech Co., Ltd.). In addition, images were evaluated in a similar way to that in Example 3-1. The evaluation results are shown in Table 3.

Example 3-13

An intermediate transfer belt 3-13 was obtained by being produced in a similar way to that of Example 3-1 except that dipentaerythritol hexaacrylate and pentaerythritol triacrylate were not used, and pentaerythritol tetraacrylate was changed to epoxy acrylate monomer EBECRYL 600 (made by Daicel Chemical Industries, Ltd., with molecular weight of 600 and number of functional groups of 2) in an amount of 30 parts by mass, in Example 3-1. The intermediate transfer belt 3-13 had a volume resistance value of $8.2\times10^{9}$ Ω·cm and a surface resistance value of $8.8\times10^{11}$ Ω/sq. (which were measured with Hiresta made by Mitsubishi Chemical Analytech Co., Ltd.). In addition, images were evaluated in a similar way to that in Example 3-1. The evaluation results are shown in Table 3.

Example 3-14

An intermediate transfer belt 3-14 was obtained by being produced in a similar way to that of Example 3-1 except that dipentaerythritol hexaacrylate and pentaerythritol triacrylate were not used, pentaerythritol tetraacrylate was changed to epoxy monomer CELLOXIDE 2021P (made by Daicel Chemical Industries, Ltd., 3,4-epoxy-cyclohexenyl methyl-3',4'-epoxy cyclohexene carboxylate) in an amount of 30 parts by mass, and a photopolymerization initiator was changed from IRGACURE 184 to ADEKA OPTOMER SP-150 (made by ADEKA CORPORATION) in an amount of 2 parts by mass, in Example 3-5. The intermediate transfer belt 3-14 had a volume resistance value of $2.1\times10^{9}$ Ω·cm and a surface resistance value of $2.3\times10^{10}$ Ω/sq. (which were measured with Hiresta made by Mitsubishi Chemical Analytech Co., Ltd.). In addition, images were evaluated in a similar way to that in Example 3-1. The evaluation results are shown in Table 3.

TABLE 3

| | Intermediate transfer member | Volume resistance value (Ω · cm) | Surface resistance value (Ω/sq.) | Image evaluation: Right after start | After 3,000 sheets | After 30,000 sheets |
|---|---|---|---|---|---|---|
| Example 3-1 | Intermediate transfer belt 3-1 | $5.1\times10^{9}$ | $9.2\times10^{10}$ | A | A | A |
| Example 3-2 | Intermediate transfer belt 3-2 | $5.7\times10^{9}$ | $4.8\times10^{10}$ | A | A | A |
| Example 3-3 | Intermediate transfer belt 3-3 | $2.5\times10^{9}$ | $4.5\times10^{10}$ | A | A | A |
| Example 3-4 | Intermediate transfer belt 3-4 | $2.6\times10^{9}$ | $3.5\times10^{10}$ | A | A | A |
| Example 3-5 | Intermediate transfer belt 3-5 | $4.0\times10^{9}$ | $3.8\times10^{10}$ | A | A | B |
| Example 3-6 | Intermediate transfer belt 3-6 | $5.6\times10^{9}$ | $4.6\times10^{10}$ | A | A | B |
| Example 3-7 | Intermediate transfer belt 3-7 | $7.2\times10^{9}$ | $1.1\times10^{11}$ | A | A | A |
| Example 3-8 | Intermediate transfer belt 3-8 | $3.6\times10^{9}$ | $2.2\times10^{10}$ | A | A | A |
| Example 3-9 | Intermediate transfer belt 3-9 | $5.4\times10^{9}$ | $6.9\times10^{10}$ | A | A | A |
| Example 3-10 | Intermediate transfer belt 3-10 | $5.5\times10^{9}$ | $1.0\times10^{11}$ | A | B | B |
| Example 3-11 | Intermediate transfer belt 3-11 | $3.8\times10^{9}$ | $4.1\times10^{10}$ | A | A | A |
| Example 3-12 | Intermediate transfer belt 3-12 | $1.1\times10^{9}$ | $7.4\times10^{11}$ | A | A | A |
| Example 3-13 | Intermediate transfer belt 3-13 | $8.2\times10^{9}$ | $8.8\times10^{11}$ | A | A | A |
| Example 3-14 | Intermediate transfer belt 3-14 | $2.1\times10^{9}$ | $2.3\times10^{10}$ | A | A | A |

Comparative Example 3-1

An intermediate transfer belt 3-15 was obtained by being produced in a similar way to that of Example 1 except that tetrafluoroethylene fine particle and a dispersing agent were not used in Example 3-1. The intermediate transfer belt 3-15 had a volume resistance value of $8.4\times10^{9}$ Ω·cm and a surface resistance value of $1.5\times10^{11}$ Ω/sq. (which were measured with Hiresta made by Mitsubishi Chemical Analytech Co., Ltd.).

In addition, images were evaluated in a similar way to that in Example 3-1. The evaluation results are shown in Table 4.

Comparative Example 3-2

An intermediate transfer belt 3-16 was obtained by being produced in a similar way to that of Comparative Example 3-1 except that the amount of PFPE (Fluorolink MD500 made by Solvay Solexis S.p.A.) was changed to 2.5 parts by mass from 0.4 parts by mass, in Comparative Example 3-1.

The intermediate transfer belt 3-16 had a volume resistance value of $1.8\times10^{10}$ Ω·cm and a surface resistance value of $1.5\times10^{11}$ Ω/sq. (which were measured with Hiresta made by Mitsubishi Chemical Analytech Co., Ltd.). In addition, images were evaluated in a similar way to that in Example 3-1. The evaluation results are shown in Table 4.

Comparative Example 3-3

An intermediate transfer belt 3-17 was obtained by being produced in a similar way to that of Comparative Example 3-1 except that 0.3 parts by mass of poly(phenyl methyl siloxane), which is a silicone-based leveling agent, was added in Comparative Example 3-1. The intermediate transfer belt 3-17 had a volume resistance value of $1.3\times10^{10}$ Ω·cm and a surface resistance value of $1.2\times10^{10}$ Ω/sq. (which were measured with Hiresta made by Mitsubishi Chemical Analytech Co., Ltd.).

In addition, images were evaluated in a similar way to that in Example 3-1. The evaluation results are shown in Table 4.

TABLE 4

| | Intermediate transfer member | Volume resistance value (Ω · cm) | Surface resistance value (Ω/sq.) | Image evaluation: Right after start | After 3,000 sheets | After 30,000 sheets |
|---|---|---|---|---|---|---|
| Comparative Example 3-1 | Intermediate transfer belt 3-15 | $8.4 \times 10^{9}$ | $1.5 \times 10^{11}$ | A | D | D |
| Comparative Example 3-2 | Intermediate transfer belt 3-16 | $1.8 \times 10^{10}$ | $6.9 \times 10^{11}$ | A | D | D |
| Comparative Example 3-3 | Intermediate transfer belt 3-17 | $1.3 \times 10^{10}$ | $1.2 \times 10^{10}$ | A | D | D |

<Calculation of Surface Free Energy>

In order to calculate the surface free energy of each fluorine compound and the tetrafluoroethylene fine particle, each fluorine compound and the tetrafluoroethylene fine particle were mixed with an acrylic monomer at the following blending ratio, respectively, and a film was produced by photopolymerization.

(Amount of Fluorine Compound to be Charged)

Pentaerythritol tetraacrylate: 30 parts by mass

Methyl ethyl ketone: 60 parts by mass

IRGACURE 184 (photopolymerization initiator): 2 parts by mass

Fluorine compound: 1 part by mass (Amount of Tetrafluoroethylene Fine Particles to be charged)

Pentaerythritol tetraacrylate: 20 parts by mass

Methyl ethyl ketone: 60 parts by mass

IRGACURE 184 (photopolymerization initiator): 2 parts by mass

LUBRON L-2 (tetrafluoroethylene fine particle): 20 parts by mass

Aron GF-300: 0.6 parts by mass

Each contact angle of pure water, diiodomethane and n-hexadecane on the produced film was measured with the use of an automatic contact angle meter DM-501 made by Kyowa Interface Science Co., Ltd., and the surface free energy was determined according to the extended Fowkes equation. The results are shown in Table 5.

TABLE 5

| Fluorine compound or tetrafluoroethylene fine particle | Surface free energy (mN/m) |
|---|---|
| Fluororink MD500 | 17 |
| Fluororink MD700 | 17 |
| Fomblin MD40 | 17 |
| OPTOOL DAC | 17 |
| HYPERTECH FA200 | 19 |
| FTERGENT 600A | 18 |
| MEGAFAC F555 | 17 |
| LUBRON L2 | 23 |

While the present invention has been described with reference to Examples, it is to be understood that the invention is not limited to the disclosed Examples. The scope of the following claims is to be accorded the broadest interpretation so as to encompass all such modifications and equivalent structures and functions.

This application claims the benefit of Japanese Patent Application No. 2011-271678, filed Dec. 12, 2011, Japanese Patent Application No. 2011-271354, filed Dec. 12, 2011, and Japanese Patent Application No. 2012-215699, filed Sep. 28, 2012 which are hereby incorporated by reference herein in their entirety.

What is claimed is:

1. An electrophotographic member comprising a base layer and a surface layer, wherein the surface layer comprises a binder resin, perfluoropolymer fine particles, a fluorocarbon resin dispersing agent and a fluorine compound, wherein the perfluoropolymer fine particle has the fluorine compound carried on the surface thereof, and wherein the fluorine compound is a perfluoropolyether compound or a branched polymer compound having a perfluoroalkyl group.

2. The electrophotographic member according to claim 1, wherein the binder resin is an acrylic resin or methacrylic resin.

3. The electrophotographic member according to claim 1, wherein the branched polymer compound having the perfluoroalkyl group is a terminal-fluorinated dendritic polymer compound.

4. The electrophotographic member according to claim 1, wherein the fluorocarbon resin dispersing agent is (i) a block copolymer obtained by copolymerizing a vinyl monomer which has a fluoroalkyl group therein, with an acrylate or a methacrylate;

or (ii) a comb-type graft copolymer obtained by copolymerizing an acrylate or methacrylate which has a fluoroalkyl group therein, with a macromonomer of a methacrylate having polymethyl methacrylate in its side chain.

5. The electrophotographic member according claim 1, wherein a surface free energy of the fluorine compound is lower than a surface free energy of the perfluoropolymer fine particle.

6. The electrophotographic member according to claim 1, wherein the perfluoropolymer fine particle is a polytetrafluoroethylene fine particle or a fine particle of a copolymer of tetrafluoroethylene and perfluoroalkyl vinyl ether.

7. An intermediate transfer member to be used in an image forming apparatus which primarily transfers a toner image that has been formed on a first image bearing member onto the intermediate transfer member, and then secondarily transfers the toner image that has been primarily transferred onto the intermediate transfer member onto a second image bearing member to obtain an image, wherein the intermediate transfer member is the electrophotographic member according to claim 1.

8. An image forming apparatus which primarily transfers a toner image that has been formed on a first image bearing member onto an intermediate transfer member, and then secondarily transfers the toner image that has been primarily transferred onto the intermediate transfer member onto a second image bearing member to obtain an image, wherein the intermediate transfer member is the electrophotographic member according to claim 1.

9. A process of preparing the electrophotographic member according to claim 1, comprising forming a surface layer on the base layer by:

a coating step of coating a dispersion having a polymerizable monomer, the perfluoropolymer fine particles, the fluorocarbon resin dispersing agent and the fluorine compound on the base layer; and a polymerizing step of polymerizing the polymerizable monomer.

10. The process of preparing the electrophotographic member according to claim 9, further comprising an outermost surface removing step of removing an outermost surface of the surface layer through an outermost surface removing operation, after the polymerizing step.

11. The process of preparing the electrophotographic member according to claim 10, wherein the outermost surface removing step is a step of removing the outermost surface of the surface layer by performing at least one treatment selected from the group consisting of plasma treatment, alkali treatment and mechanical polishing treatment.

* * * * *